US005675985A

United States Patent [19]

Lee

[11] Patent Number: 5,675,985

[45] Date of Patent: Oct. 14, 1997

[54] COOL AIR SUPPLYING APPARATUS

[75] Inventor: Sang-Moo Lee, Incheon, Rep. of Korea

[73] Assignee: Daewoo Electronics Co., Ltd., Seoul, Rep. of Korea

[21] Appl. No.: 685,923

[22] Filed: Jul. 22, 1996

[30] Foreign Application Priority Data

Jul. 20, 1995 [KR] Rep. of Korea ..... 95-21436

[51] Int. Cl.[6] ..... F25D 17/04

[52] U.S. Cl. ..... 62/408; 62/441

[58] Field of Search ..... 62/441, 440, 407, 62/408, 409; 454/285

[56] References Cited

U.S. PATENT DOCUMENTS 4,732,014 3/1988 Frohbieter ..... 62/408

5,092,137 3/1992 Elsom ..... 62/408

*Primary Examiner*—John M. Sollecito

*Attorney, Agent, or Firm*—Beveridge, DeGrandi, Weilacher & Young LLP

[57] ABSTRACT

A cool air supplying apparatus capable of dispersedly supplying cool air into the refrigerator by use of a swing plate disposed within a cool duct is disclosed. The cool duct comprises a main duct extending through a freezing room and a refrigerating room and at least one sub-duct communicated with the main duct and having a plurality of holes for supplying the cool air. The swing plate is disposed within the sub-duct along its longitudinal direction. A shaft is disposed within the main duct to be capable of reciprocating along its longitudinal direction and is operatively connected with the swing plate. A motor is installed at an upper portion of the main duct, and a crank is operatively connected with each of a rotary shaft of the motor and the shaft. The shaft and the swing plate are operatively connected with each other by means of a protrusion formed at a long side of the swing plate and having an U-shaped groove through which the shaft passes and pairs of collars fixed on the shaft to insert the protrusion therebetween.

8 Claims, 4 Drawing Sheets

11
12
13
14
15
16
17
18
19
20
21

COOL AIR SUPPLYING APPARATUS

BACKGROUND OF THE INVENTION

1. Field of the invention

The present invention relates to a cool air supplying apparatus, and more particularly to a cool air supplying apparatus provided with swing plates for dispersedly supplying cool air into a refrigerator.

2. Description of the Prior Art

FIG. 1 is a cut-out perspective view showing a conventional cool air supplying apparatus. As shown in FIG. 1, a cool air supplying duct 10 extends to a refrigerating room from a freezing room. A plurality of cool air supplying holes 11 are provided along the longitudinal direction of cool air supplying duct 10. The cool air produced by a evaporator (not shown) is supplied to cool air supplying duct 10 and, through cool air supplying holes 11, to the refrigerating and freezing rooms.

However, in this conventional cool air supplying apparatus, the cool air supplied through cool air supplying holes 11 positioned upstream is more than that through cool air supplying holes 11 positioned downstream in amount because of the pressure difference between the upstream and downstream portion of cool air supplying duct 10. Besides, the cool air is not dispersedly supplied into the refrigerator, since the direction of supplying the cool air is not changed. The cool air is not sufficiently supplied to the lower portion of the refrigerator and not dispersedly supplied thereinto, with the result that a relatively wide distribution of the temperature is caused within the refrigerator, especially within the refrigerating room having a relatively large volume.

SUMMARY OF THE INVENTION

The present invention is devised to solve the foregoing problems. An object of the present invention is to provide a cool air supplying apparatus capable of dispersedly supplying cool air into the refrigerator by use of swing plates disposed within a cool duct.

To achieve the above object of the present invention, there is provided a cool air supplying apparatus comprising:

- a hollow duct comprising a main duct extending through a freezing room and a refrigerating room and being supplied with cool air produced by an evaporator, and at least one sub-duct communicated with the main duct and having a plurality of holes for supplying the cool air;
- at least one swing plate disposed within the sub-duct to be capable of swinging around a longitudinal axis of the sub-duct;
- a shaft disposed within the main duct to be capable of reciprocating along a longitudinal direction of the main duct;
- connecting means for operatively connecting the swing plate with the shaft; and
- producing means for producing rectilinearly reciprocating movement of the shaft.

For example, the producing means comprises a motor installed at an upper portion of the main duct and a crank operatively connected with each of a rotary shaft of the motor and the shaft.

The connecting means may include a protrusion formed at a long side of the swing plate and having an U-shaped groove through which the shaft passes and pairs of collars fixed on the shaft to insert the protrusion therebetween.

Further, the swing plate may include a supporting shaft extending through the swing plate along a longitudinal direction thereof, and both ends of the supporting shaft are projected from the swing plate to be supported on the inner wall of a refrigerator, thereby allowing the swing plate to be capable of swinging around the supporting shaft.

BRIEF DESCRIPTION OF THE DRAWINGS

The above object and other advantages of the present invention will become more apparent by describing in detail preferred embodiment thereof with reference to the attached drawings in which.

DETAILED DESCRIPTION OF THE PREFERRED EMBODIMENT

Figure 1:
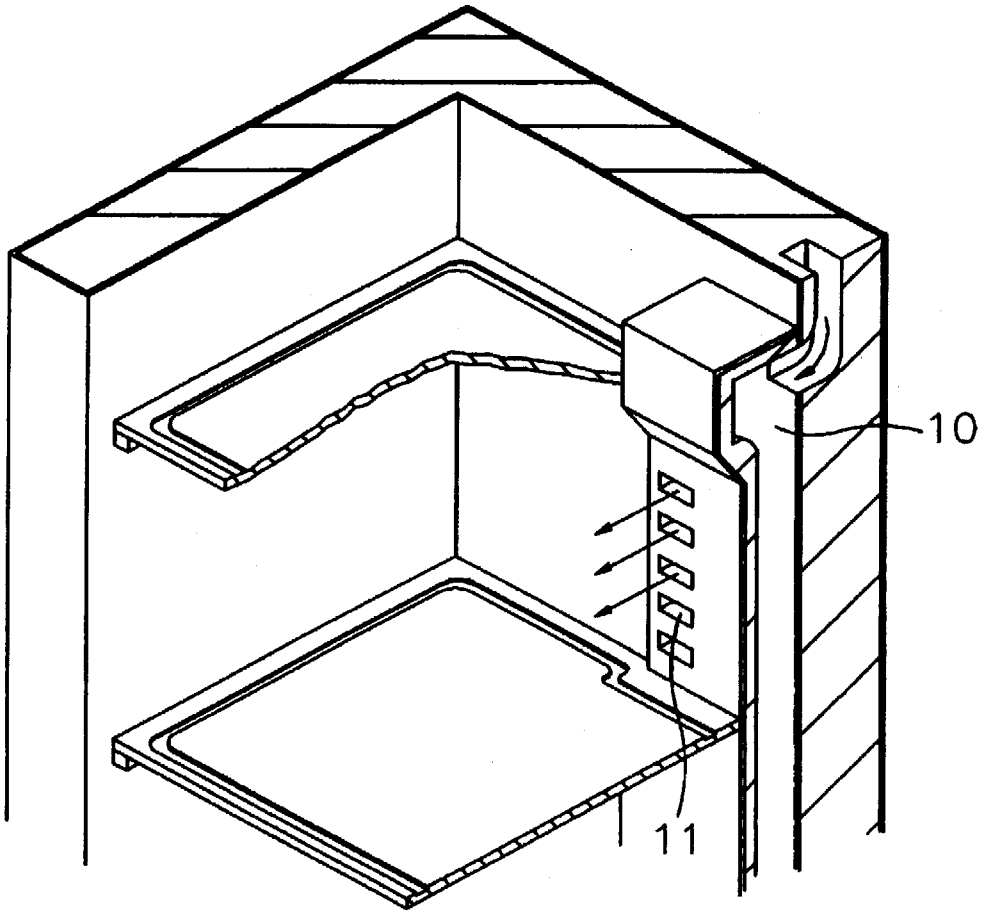
FIG. 1 is a cut-out perspective view in which part of a wall of the refrigerator is cut out, showing the construction of a conventional cool air supplying apparatus.
Figure 2:
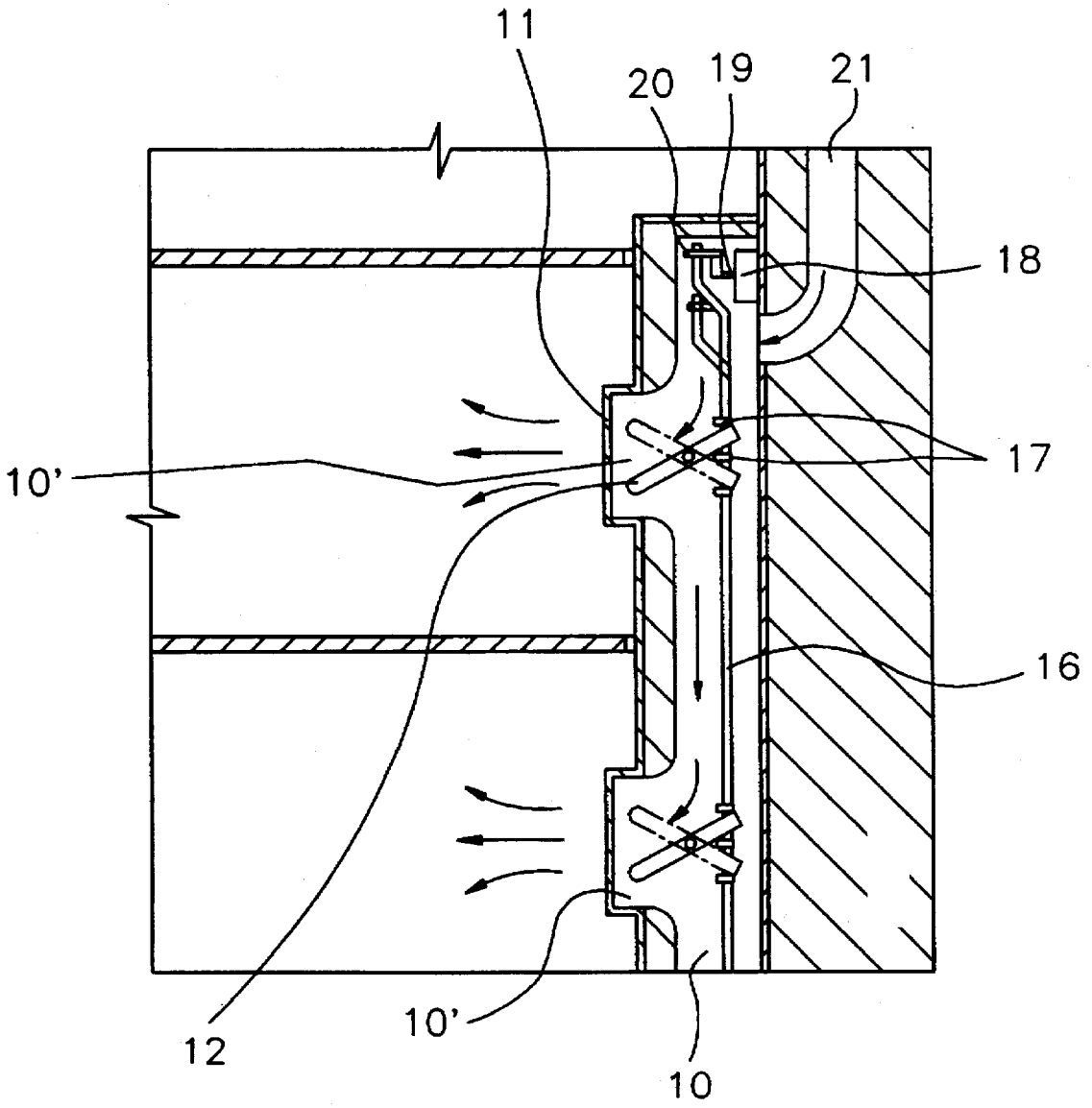
FIG. 2 is a sectional view showing a cool air supplying apparatus according to a first embodiment of the present invention.
Figures 3A, 3B:
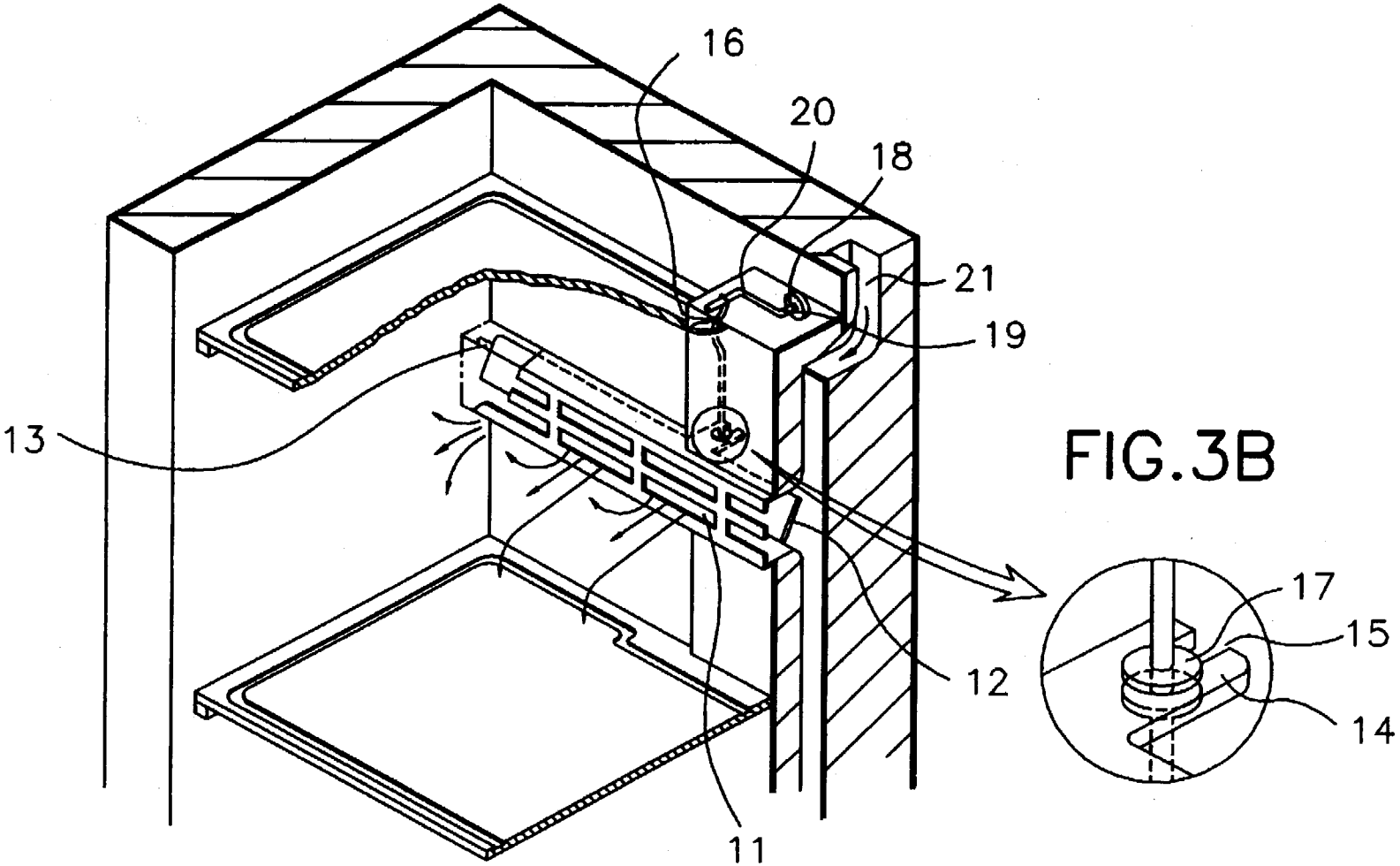
FIG. 3 is a cut-out perspective view showing the construction of the cool air supplying apparatus shown in FIG. 2.

Hereinafter, the first embodiment of the present invention will be described in detail with reference to FIGS. 2 and 3.

A cool air supplying duct 10 extends to a refrigerating room from a freezing room in the longitudinal direction of the refrigerator along the inner wall thereof. Cool air supplying duct 10 is communicated with one or more sub-ducts 10' extending perpendicularly to cool air supplying duct 10 along the inner wall of the refrigerator. One or more sub-ducts 10' are disposed within each of the refrigerating and freezing rooms at an interval. Sub-duct 10' have a plurality of holes 11 for supplying cool air into the refrigerator.

A swing plate 12 is installed within sub-duct 10' in the longitudinal direction of sub-duct 10'. Swing plate 12 has a rectangular shape and is supported to be capable of swinging by means of a supporting shaft 13. Supporting shaft 13 passes through swing plate 12 in the longitudinal direction thereof, and both ends of supporting shaft 13 are projected from swing plate 12. Both ends of projected supporting shaft 13 are supported on the inner wall of the refrigerator, thereby allowing swing plate 12 to be capable of swinging within sub-duct 10'.

A protrusion 14 is formed at a long side of swing plate 12. Protrusion 14 has an U-shaped groove 15. A shaft 16 is disposed within cool air supplying duct 10 in its longitudinal direction. Shaft 16 extends passing through U-shaped groove 15 formed at protrusion 14. Pairs of collars 17 are fixed on shaft 16, and the number of pairs of collars 17 is equal to that of swing plates 12. Protrusion 14 is inserted between a pair of collars 17, so that swing plate 12 and shaft 16 are operatively connected with each other.

A motor 18 is installed at an upper portion of cool air supplying duct 10. A rotary shaft 19 of motor 18 is operatively connected with a crank 20 which is operatively connected with shaft 16. Thus, the rotary movement of rotary shaft 19 is transformed into the rectilinearly reciprocating movement of shaft 16 by means of crank 20. The reciprocating distance of shaft 16 is equal to the rotary diameter of crank 20.

The function and effect of the first embodiment of the present invention will be described. The cool air is produced by an evaporator (not shown) and is supplied into cool air supplying duct 10 through a connection duct 21. When the cool air is produced, motor 18 is started. At the same time, crank 20 is rotated connected with rotary shaft 19. Since an end of crank 20 is operatively connected with shaft 16, shaft 19 is subjected to the rectilinearly reciprocating movement.

When shaft 19 reciprocates rectilinearly, swing plate 12, which is operatively connected with shaft 16 by means of protrusion 14, is subjected to swinging around supporting shaft 13.

The traveling direction of the cool air supplied into sub-duct 10' by way of cool air supplying duct 10 is periodically changed by means of swing plate 12 for swinging around supporting shaft 13. As a result, the cool air is dispersedly supplied into the refrigerating and freezing rooms, passing through holes 11.

Figure 4:
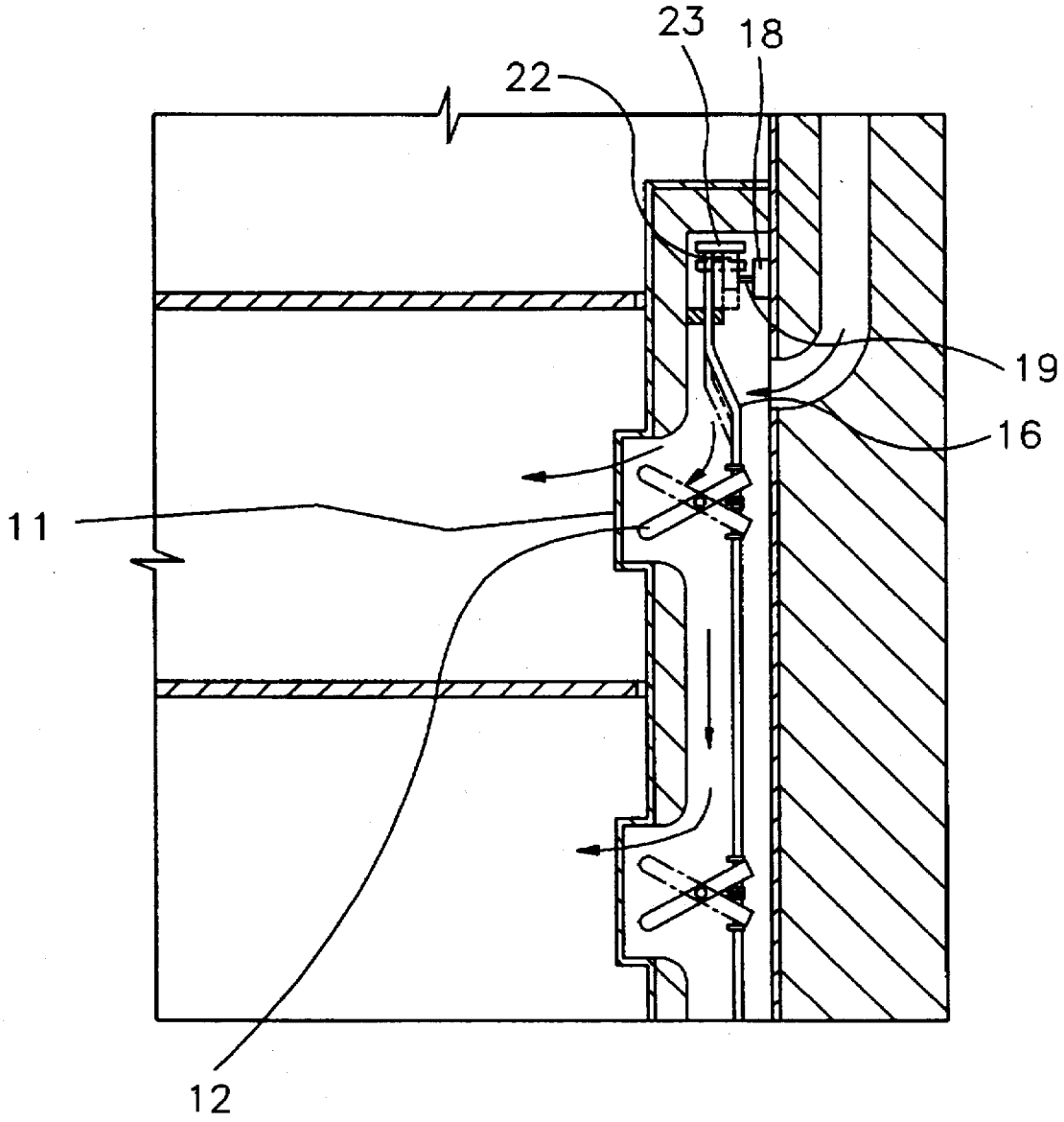
FIG. 4 is a sectional view showing a cool air supplying apparatus according to a second embodiment of the present invention.

FIG. 4 shows a second embodiment of a cool air supplying according to the present invention.

In the second embodiment, a cam 22 and an arm 23 is substituted for crank 20 of the first embodiment. Cam 22 is operatively connected with rotary shaft 19, and arm 23 is provided to the upper end of shaft 16. Cam 22 and arm 23 are operatively connected in sliding contact with each other. With the rotation of cam 22, shaft 16 operatively connected with arm 23 is subjected to the rectilinearly reciprocating movement. The others of constituents are equal in the first embodiment, so the description thereof is omitted.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A cool air supplying apparatus comprising:

a hollow duct comprising a main duct extending through a freezing room and a refrigerating room and being supplied with cool air produced by an evaporator, and at least one sub-duct communicated with said main duct and having a plurality of holes for supplying the cool air;

at least one swing plate disposed within said sub-duct to be capable of swinging around a longitudinal axis of said sub-duct;

a shaft disposed within said main duct to be capable of reciprocating along a longitudinal direction of said main duct;

connecting means for operatively connecting said swing plate with said shaft; and producing means for producing rectilinearly reciprocating movement of said shaft.

2. The cool air supplying apparatus as claimed in claim 1, wherein said producing means comprises a motor installed at an upper portion of said main duct and a crank operatively connected with each of a rotary shaft of said motor and said shaft.

3. The cool air supplying apparatus as claimed in claim 1, wherein said connecting means comprises a protrusion formed at a long side of said swing plate and having an U-shaped groove through which said shaft passes and pairs of collars fixed on said shaft to insert said protrusion therebetween.

4. The cool air supplying apparatus as claimed in claim 3, wherein the number of said pairs of collars is equal to that of said swing plate operatively connected with said shaft.

5. The cool air supplying apparatus as claimed in claim 1, wherein said swing plate includes a supporting shaft extending through said swing plate along a longitudinal direction thereof, and both ends of said supporting shaft are projected from said swing plate to be supported on the inner wall of a refrigerator, thereby allowing said swing plate to be capable of swinging around said supporting shaft.

6. A cool air supplying apparatus comprising:

a hollow duct comprising a main duct extending through a freezing room and a refrigerating room and being supplied with cool air produced by an evaporator, and at least one sub-duct communicated with said main duct and having a plurality of holes for supplying the cool air;

at least one swing plate disposed within said sub-duct to be capable of swinging around a longitudinal axis of said sub-duct;

a shaft disposed within said main duct to be capable of reciprocating along a longitudinal direction of said main duct;

connecting means for operatively connecting said swing plate with said shaft; and producing means for producing rectilinearly reciprocating movement of said shaft, said producing means comprising a motor installed at an upper portion of said main duct, a cam installed on a rotary shaft of said motor and an arm fixed on an upper end of said shaft in the perpendicular direction to said shaft to be in sliding contact with said cam.

7. The cool air supplying apparatus as claimed in claim 6, wherein said connecting means comprises a protrusion formed at a long side of said swing plate and having an U-shaped groove through which said shaft passes and pairs of collars fixed on said shaft to insert said protrusion therebetween, and the number of said pairs of collars is equal to that of said swing plate operatively connected with said shaft.

8. A cool air supplying apparatus comprising:

a hollow duct comprising a main duct extending through a freezing room and a refrigerating room and being supplied with cool air produced by an evaporator, and at least one sub-duct communicated with said main duct and having a plurality of holes for supplying the cool air;

at least one swing plate disposed within said sub-duct to be capable of swinging around a longitudinal axis of said sub-duct;

a shaft disposed within said main duct to be capable of reciprocating along a longitudinal direction of said main duct;

connecting means for operatively connecting said swing plate with said shaft; and producing means for producing rectilinearly reciprocating movement of said shaft, wherein said producing means comprises a motor installed at an upper portion of said main duct and a crank operatively connected with each of a rotary shaft of said motor and said shaft, said connecting means comprises a protrusion formed at a long side of said swing plate and having an U-shaped groove through which said shaft passes and pairs of collars fixed on said shaft to insert said protrusion therebetween, the number of said pairs of collars is equal to that of said swing plate operatively connected with said shaft, and said swing plate includes a supporting shaft extending through said swing plate along a longitudinal direction thereof, and both ends of said supporting shaft are projected from said swing plate to be supported on the inner wall of a refrigerator, thereby allowing said swing plate to be capable of swinging around said supporting shaft.

* * * * *